US005887551A

United States Patent [19]

Ban et al.

[11] Patent Number: 5,887,551

[45] Date of Patent: Mar. 30, 1999

[54] VISCOUS FLUID TYPE HEAT GENERATOR WITH HEAT-GENERATING PERFORMANCE CHANGING ABILITY

[75] Inventors: Takashi Ban; Shigeru Suzuki; Kenji Takenaka; Tatsuya Hirose, all of Kariya, Japan

[73] Assignee: Kabushiki Kaisha Toyoda Jidoshokki Seisakusho, Kariya, Japan

[21] Appl. No.: 46,139

[22] Filed: Mar. 23, 1998

[30] Foreign Application Priority Data

Mar. 25, 1997 [JP] Japan ..... 9-072049

[51] Int. Cl.[6] ..... F22B 3/06

[52] U.S. Cl. ..... 122/26; 237/17.3 R; 176/247

[58] Field of Search ..... 237/12.3 R, 12.3 B; 126/247; 122/26; 123/142.5 R

[56] References Cited

U.S. PATENT DOCUMENTS 4,974,778 12/1990 Bertling .
4,993,377 2/1991 Itakura .

FOREIGN PATENT DOCUMENTS 2254010 10/1990 Japan .
357877 3/1991 Japan .

*Primary Examiner*—Henry Bennett
*Assistant Examiner*—Derek S. Boles
*Attorney, Agent, or Firm*—Burgess, Ryan & Wayne

[57] ABSTRACT

A viscous fluid type heat generator having a heat generating chamber in which heat generation by the viscous fluid is performed in response to the rotation of a rotor element applying a shearing action to the viscous fluid, a heat receiving chamber in which a heat exchanging liquid flows to receive heat from the heat generating chamber, a heat generation control chamber for containing the viscous fluid to be supplied into the heat generating chamber and receiving the viscous fluid withdrawn from the heat generating chamber. The heat generator has a fluid supplying passage for supplying the viscous fluid from the heat generation control chamber to the heat generating chamber, a fluid withdrawing passage for withdrawing the viscous fluid from the heat generating chamber into the heat generation control chamber, a flap valve deformable to open and close the fluid withdrawing passage in response to a change in a heating requirement, and a valve deformation supplementing means to provide the flap valve with additional deformation effect to quickly and timely open the flap valve. The valve supplementing means may be a subsidiary fluid port to introduce therein the viscous fluid from the heat generating chamber so as to cause a supplementary deformation of the flap valve.

10 Claims, 3 Drawing Sheets

VISCOUS FLUID TYPE HEAT GENERATOR WITH HEAT-GENERATING PERFORMANCE CHANGING ABILITY

BACKGROUND OF THE INVENTION

1. Field of the Invention

The present invention generally relates to a viscous fluid type heat generator in which heat is generated by forcibly shearing a viscous fluid confined in a chamber and the heat is transmitted to a heat exchanging liquid circulating through a heating system. More particularly, the present invention relates to a variable heat-generating performance, viscous-fluid-type heat generator provided with an improved ability to adjustably change its heat-generating performance in response to a change in a requirement for either increasing or reducing the amount of heat to be supplied to an objective heated area.

2. Description of the Related Art

Japanese Unexamined (Kokai) Utility Model Publication No. 3-98107 (JU-A-3-98107) discloses a viscous fluid type heat generator adapted to be incorporated into an automobile heating system as a supplemental heat source. The viscous fluid type heat generator of JU-A-3-98107 is formed as a heat generator provided with a unit for changing its heat-generating performance. The heat generator of JU-A-3-98107 includes front and rear housings connected together to form a housing assembly in which a heat-generating chamber, for permitting a viscous fluid to generate heat, and a heat receiving chamber arranged adjacent to the heat generating chamber, for permitting a heat exchanging liquid to receive the heat from the heat generating chamber, are formed. The heat receiving chamber in the housing assembly permits the heat exchanging liquid to flow therethrough from a liquid inlet port to a liquid outlet port formed in a portion of the housing assembly. Namely, the heat exchanging liquid is circulated through the heat receiving chamber and a separate heating circuit of the automobile heating system so as to supply the heat to the objective area, e.g., a passenger compartment of the automobile during the operation of the heating system. The heat exchanging liquid flows into and out of the heat receiving chamber through the liquid inlet port and the liquid outlet port. The heat generator of JU-A-3-98107 further includes a drive shaft rotatably supported by bearings which are seated in the front and rear housings of the housing assembly. A rotor element is mounted on the drive shaft so as to be rotated together with the drive shaft within the heat generating chamber. The inner wall surface of the heat generating chamber and the outer surfaces of the rotor element define labyrinth grooves in which a viscous fluid, such as silicone oil having a chain-molecular structure, is held to generate heat in response to the rotation of the rotor element.

The heat generator of JU-A-3-98107 has such a characteristic arrangement that upper and lower housings are attached to a bottom portion of the housing assembly to form a heat-generation control chamber therein. The heat-generation control chamber is formed as a volume-variable chamber having a wall consisting of a membrane such as a diaphragm.

The heat generating chamber communicates with the atmosphere via a through-hole bored in an upper portion of the front and rear housings of the housing assembly, and with the heat generation control chamber via a communicating channel arranged between the heat generation control chamber and the heat generating chamber. The volume of the heat generation control chamber is adjustably changed by the movement of the diaphragm which is caused by a spring element having a predetermined spring factor or an externally supplied signal such as a pressure signal supplied from an engine manifold of an automobile.

When the drive shaft of the heat generator of JU-A-3-98107 incorporated in an automobile heating system is driven by an automobile engine, the rotor element is rotated within the heat generating chamber, so that heat is generated by the viscous fluid, to which a shearing force is applied, between the inner wall surface of the heat generating chamber and the outer surfaces of the rotor element. The heat generated by the viscous fluid is transmitted from the heat generating chamber to the heat exchanging liquid, i.e., engine-cooling water circulating through the heating system and carried by the water to a heating circuit of the heating system to warm an objective heated area such as a passenger compartment.

When it is detected that the objective area is excessively heated with respect to a reference temperature value predetermined for that area, through the detection of the temperature of the viscous fluid, the diaphragm of the heat generation control chamber is moved in response to a vacuum pressure signal supplied from the engine manifold to increase the volume of the heat generation control chamber. Accordingly, the viscous fluid is withdrawn from the heat generating chamber into the heat generation control chamber to reduce the generation of heat by the viscous fluid between the inner wall surface of the heat generating chamber and the outer surfaces of the rotor element. Therefore, the heat-generation performance can be reduced, i.e., the amount of heat applied to the objective heated area can become less.

When it is detected that heating of the objective heated area is excessively low with respect to the predetermined reference temperature value, through the detection of the temperature of the viscous fluid, the diaphragm of the heat generation control chamber is moved by the pressure signal and by the spring force of the spring element to reduce the volume of the heat-generation control chamber. Therefore, the viscous fluid contained in the heat-generation control chamber is supplied into the heat-generating chamber so as to increase the heat-generation by the viscous fluid between the inner wall surface of the heat generating chamber and the outer surfaces of the rotor element. As a result, the heat-generation performance can be increased, i.e., the amount of heat supplied to the objective heated area becomes large.

Nevertheless, in the viscous fluid type heat generator having variable heat generating performance, as disclosed in JU-A-3-98107, when the viscous fluid is withdrawn from the heat generating chamber into the heat generation control chamber, atmospheric air is introduced from the through-hole of the housing assembly into the heat generating chamber so as to prevent a vacuum occurring in the heat generating chamber due to the withdrawal of the viscous fluid therefrom. Thus, the viscous fluid must come into contact with atmospheric air whenever a change in the heat-generation performance of the heat generator occurs, and is oxidized. Therefore, a gradual degradation of the heat generating characteristics of the viscous fluid occurs. Further, the above-mentioned through-hole formed in the housing assembly permits a certain amount of moisture to enter from the atmosphere into the heat generating chamber of the heat generator, and accordingly, the viscous fluid is adversely affected by the moisture within the heat generating chamber after a long operating time of the heat generator, so that the heat generating characteristics of the viscous fluid must be again degraded.

Further, the viscous fluid type heat generator of JU-A-3-98107 is not internally provided with a mechanism or a means for conducting an appropriate exchange of the viscous fluid between the heat generating chamber and the heat generation control chamber. Thus, when the drive shaft is continuously rotated at a high speed without the viscous fluid being withdrawn from the heat generating chamber into the heat generating control chamber, the viscous fluid confined in the heat generating chamber is continuously subjected to a shearing action by the rotor element and can be heated to an extremely high temperature at which temperature the physical property of the viscous fluid is degraded to reduce the heat generation performance.

U.S. Pat. No. 4,974,778, and the corresponding German laid-open publication DE-3832966, disclose a different type of heating system, for a vehicle with a liquid-cooled internal combustion engine, which includes a viscous fluid type heating unit. The viscous fluid type heating unit of U.S. Pat. No. '778 includes a housing defining a heat-generating chamber or a working chamber having a through-opening, and a heat-generation control chamber or a viscous fluid supply chamber communicating with the heat generating chamber via the through-opening. The through-opening between the heat generating chamber and the heat generation control chamber is closed and opened by a spring-operated closing means, and accordingly, the degradation of the viscous fluid can be avoided even after either long use of the heating unit or after a high-speed continuous operation of the heating unit. The spring-operated closing means of the heating unit of U.S. Pat. No. '778 is provided with a lever member having one pivotally supported end and the other free end to which a closing member is attached to be able to close the through-opening, a resilient member for constantly urging the closing member toward the through-opening via the lever member, and a leaf spring made of a bimetallic material deformable in response to a change in the temperature of the viscous fluid and attached to the lever member so as to be deformed against the spring force of the resilient member. Thus, a thermal deformation of the bimetallic leaf spring causes the lever member to pivotally move to cause the closing member held by the lever member to be moved toward and away from the through-opening between the heat generating chamber and the heat generation control chamber against the spring force of the resilient member. However, employment of a plurality of operating members for constituting the closing means to close the through-opening between the heat generating chamber and the heat generation control chamber causes such an unfavorable operating condition that any deformation of the bimetallic leaf spring due to a change in the temperature of the viscous fluid within the heat generation control chamber does not cause an immediate movement of the closing member toward and away from the through-opening. Further, a controlling operation of the closing means might become inaccurate due to total manufacturing tolerances of all of the plurality of operating members of the closing means. Namely, the performance of the closing means of the through-opening of the viscous fluid type heating unit of U.S. Pat. No. '778 is insufficient for controlling the heat-generation performance of the viscous fluid type heating unit quickly and accurately. Further, the use of the plurality of operating members to constitute the closing means of the through-opening between the heat generating chamber and the heat generation control chamber causes an increase not only in a manufacturing cost or the closing means but also in the difficulty in assembling the closing means in the heating unit of the heating system. Moreover, the closing means of the viscous fluid type heating unit of U.S. Pat. No. '778 has a relatively large size requiring a large volume in the heat generation control chamber to receive therein the closing means. As a result, the mounting of the viscous fluid type heating unit in a vehicle at a position suitable for receiving a drive power from the vehicle internal combustion engine must be difficult.

By taking into consideration the above-mentioned various defects of the viscous fluid type heating units according to the prior art, the present inventors have sought measures for solving the defects of the viscous fluid type heating unit according to the prior art, and have considered and tested a flap valve capable of deforming by itself in order to open and close a through-opening arranged between a heat generating chamber and a heat generation control chamber of a viscous fluid type heat generator having a variable heat generating performance. Nevertheless, it was experimentally confirmed that an arrangement of the flap valve in the heat generation control chamber to control the opening and closing of the through-opening between the heat generating chamber and the heat generation control chamber is still insufficient for obtaining accurate and rapid response performance in controlling the heat-generation performance of the viscous-fluid-type heat generator. Namely, when a flap valve is disposed in the heat-generation control chamber so as to openably close an end opening of a fluid withdrawing passage, only the viscous fluid within the heat generating chamber comes into contact with the flap valve only through the fluid withdrawing passage. Therefore, the flap valve is not deformed appropriately to open the end opening of the fluid withdrawing passage. This inappropriate opening of the flap valve occurs because the fluid withdrawing passage must be formed as a small through-bore having a very small diameter in order to be correctly closed when the heat generator operates at a low speed while generating a small amount of heat and the flap valve closing and opening the small through-bore cannot come into contact with a sufficient amount of the viscous fluid of the heat generating chamber via the small fluid withdrawing passage. This unfavorable and inappropriate opening of the flap valve occurs irrespective of a difference in the type of the flap valve between a reed type flap valve deformable in response to a change in a pressure prevailing in the heat generating chamber and a thermally deformable bimetallic flap valve.

Specifically, when a flap valve is a thermally deformable bimetallic flap valve, the viscous fluid within the heat generating chamber is not able to transmit a sufficient amount of heat to the flap valve via the fluid withdrawing passage having a small diameter, and accordingly, a temperature transmission from the viscous fluid to the flap valve does not easily occur. Thus, the employment of the flap valve for controlling the opening and closing the end opening of the fluid withdrawing passage of the viscous fluid type heat generator is insufficient for obtaining an accurate and quick control of the heat generation performance of the heat generator. Particularly, control of a reduction in the heat-generation performance of the viscous fluid type heat generator cannot be achieved quickly and accurately.

SUMMARY OF THE INVENTION

Therefore, an object of the present invention is to provide a viscous fluid type heat generator having a variable heat generating performance, capable of obviating all defects encountered by the conventional viscous fluid type heat generator having a variable heat generating performance.

Another object of the present invention is to provide a viscous fluid type heat generator having a variable heat-generat ion performance capable of maintaining a good heat-generation performance after not only a long use thereof but also a continuous operation thereof at a high operating speed.

A further object of the present invention is to provide a viscous fluid type heat generator having a variable heat-generat ion performance able to conduct an accurate and quick control of a reduction in the heat-generation performance of the heat generator in response to a change in a heat generating requirement.

In accordance with the present invention, there is provided a variable-heat-generating-performance, viscous-fluid-type heat generator comprising:

a housing assembly, defining therein a fluid-tight heat generating chamber in which heat is generated, and a heat receiving chamber arranged adjacent to the fluid-tight heat generating chamber to permit a heat exchanging fluid to circulate therethrough to thereby receive heat from the fluid-tight heat generating chamber, the fluid-tight heat generating chamber having inner wall surfaces thereof;

a drive shaft supported by the housing assembly to be rotatable about an axis of rotation thereof, the drive shaft being operatively connected to an external rotation-drive source;

a rotor element mounted to be rotationally driven by the drive shaft for rotation together therewith within the fluid-tight heat generating chamber, the rotor element having outer faces confronting the inner wall surfaces of the fluid-tight heat generating chamber via a predetermined gap;

a viscous fluid, filling the gap between the inner wall surfaces of the fluid-tight heat generating chamber of the housing assembly and the outer faces of the rotor element, for heat generation during the rotation of the rotor element, wherein the housing assembly further comprises:

a heat generation control chamber formed therein to have a given amount of volume for containing the viscous fluid therein;

a fluid withdrawing passage for passing the viscous fluid from the heat generating chamber toward the heat generation control chamber to permit at least a part of the viscous fluid in the heat generating chamber to be withdrawn into the heat generation control chamber for reducing a heat-generation performance of the viscous fluid type heat generator, the fluid withdrawing passage having opposite open ends thereof;

fluid supplying passage for passing the viscous fluid from the heat generation control chamber toward the heat generating chamber to permit at least a part of the viscous fluid in the heat generation control chamber to be supplied into the heat generating chamber for increasing a heat-generation performance of the viscous fluid type heat generator, the fluid supplying passage having opposite open ends;

a flap valve means for closing one of the opposite open ends of the fluid withdrawing passage, the flap valve means being deformable to move from the closing position thereof; and, a valve deformation supplementing means for permitting the viscous fluid in the heat generating chamber to come into contact with the flap valve means to thereby allow the flap valve means to be supplementarily deformed to quickly open one of the opposite open ends of the fluid withdrawing passage, the opening of the fluid withdrawing passage permitting the viscous fluid to be withdrawn from the heat generating chamber into the heat generation control chamber via the fluid withdrawing passage so as to reduce a heat-generation performance of the heat generator.

Preferably, when the flap valve means comprises a thermally deformable bimetallic type flap valve having a free end operative to open one of the opposite ends of the fluid withdrawing passage and a base end by which the bimetallic type flap valve is attached to the housing assembly, the valve deformation supplementing means comprises a subsidiary fluid port formed in the housing assembly at a position adjacent to the base end of the bimetallic type flap valve.

Further preferably, when the flap valve means comprises a thermally deformable bimetallic type flap valve having a free end operative to open one of the opposite ends of the fluid withdrawing passage and a base end by which the bimetallic type flap valve is attached to the housing assembly, the valve deformation supplementing means comprises a fluid guide passage having one end arranged to fluidly communicate with an outer circumferential portion of the heat generating chamber.

In the described viscous fluid type heat generator, the heat generation control chamber and the heat generating chamber of the housing assembly communicate with one another via the fluid supplying passage and the fluid withdrawing passage. Thus, when the open ends of the fluid supplying passage are opened, the viscous fluid can be supplied from the heat generation control chamber into the heat generating chamber via the fluid supplying passage. Further, when the open ends of the fluid withdrawing passage are opened, the viscous fluid is withdrawn from the heat generating chamber into the heat generation control chamber, and accordingly, the heat generation by the viscous fluid held between the inner wall surfaces of the heat generating chamber and the outer faces of the rotor element is reduced to cause a reduction in the heat-generation performance of the heat generator. Therefore, the viscous fluid heat generator supplies an associated heating system, e.g., a heating system of an engine-operated vehicle, with a reduced amount of heat so that heating of an objective heated area is reduced. On the other hand, when the fluid withdrawing passage is blocked by closing of the flap valve, the viscous fluid is not withdrawn from the heat generating chamber into the heat generation control chamber and accordingly, the heat generation by the viscous fluid held between the inner wall surfaces of the heat generating chamber and the outer faces of the rotor element is increased to increase the heat-generation performance of the heat generator. Thus, the heating system is supplied from the heat generator with an increased amount of heat to be conducted to the objective heated area.

It should be understood that an increase and a reduction in the heat-generation performance of the heat generator can be selectively regulated by adjusting the amount of supply of the viscous fluid and the amount of withdrawal of the viscous fluid performed between the heat generating chamber and the heat generation control chamber at the stage of designing, manufacturing and assembly of the viscous fluid type heat generator. For example, by appropriately designing the cross-sectional area of either one of the fluid supplying and withdrawing passageways or both of these passages, the above-mentioned amount of supply of the viscous fluid and amount of withdrawal of the viscous fluid can be regulated.

In the described viscous fluid type heat generator, during the withdrawing of the viscous fluid from the heat generating chamber into the heat generation control chamber, and also during the supplying of the viscous fluid from the heat generation control chamber to the heat generating chamber, a total internal volume of the heat generating chamber, the fluid withdrawing passage, the fluid supplying passage, and the heat generation control chamber of the housing assembly is unchanged, and accordingly, the flow or movement of the viscous fluid does not generate a vacuum portion within the housing assembly. Thus, no fresh air is introduced into the afore-mentioned heat generating chamber, the fluid withdrawing passage, the fluid supplying passage, and the heat generation control chamber, and accordingly, the viscous fluid filled in the heat generator does not come into contact with fresh air. Thus, degradation of the heat generating characteristics of the viscous fluid can be prevented. In addition, since a moisture component in the atmosphere is not permitted to enter into the housing assembly, the viscous fluid is not adversely affected by the moisture. Therefore, the heat generating characteristics of the viscous fluid can be constant over a long operating life of the heat generator.

Further, in the described viscous fluid type heat generator, even if the drive shaft is continuously rotated at a high speed, the viscous fluid in the heat generating chamber can be replaced with the viscous fluid stored in the heat generation control chamber through the fluid supplying passage and the fluid withdrawing passage. Therefore, the viscous fluid within the heat generating chamber is not heated up to an extremely high temperature which is far above a usable temperature limit. Thus, degradation of the viscous fluid can be prevented. Accordingly, the heat generator can maintain its heat-generation performance after a continuous high speed operation thereof.

Further, in the described viscous fluid type heat generator, the fluid communication between the heat generating chamber and the heat generation control chamber via the fluid withdrawing passage is controlled by the opening and closing of the flap valve means deformable thermally or by pressure. At this stage, the viscous fluid in the heat generating chamber is permitted by the valve deformation supplementing means to flow toward and come into contact with the flap valve means so as to assist deformation of the flap valve means. Namely, when the flap valve means is constituted by a reed type flap valve, the reed type flap valve receives an increased amount of fluid pressure of the viscous fluid by the valve deformation supplementing means. Thus, the deformation of the reed type flap valve by pressure can easily occur to quickly and accurately open the fluid withdrawing passage. When the flap valve means is constituted by a bimetallic flap valve, the bimetallic flap valve can receive an increased amount of heat from the viscous fluid by the valve deformation supplementing means. Thus, the thermal deformation of the bimetallic type flap valve can easily occur to timely, quickly and accurately open the fluid withdrawing passage. Therefore, even if the fluid withdrawing passage is formed as a through-bore having a small diameter in order that the fluid withdrawing passage can be sealingly closed by the flap valve means when the heat generator is operated at a low speed while generating a small amount of heat, the small diameter fluid withdrawing passage can be easily opened. Namely, the fluid withdrawing passage can be accurately opened precisely at the time when it should be opened. As a result, a reduction in the heat-generation performance of the heat generator can be quickly and accurately achieved in response to a change in a heating requirement from the heating system.

BRIEF DESCRIPTION OF THE DRAWINGS

The above and other objects, features, and advantages of the present invention will be made more apparent from the ensuing description of the drawings wherein.

DESCRIPTION OF THE PREFERRED EMBODIMENTS

Figure 1:
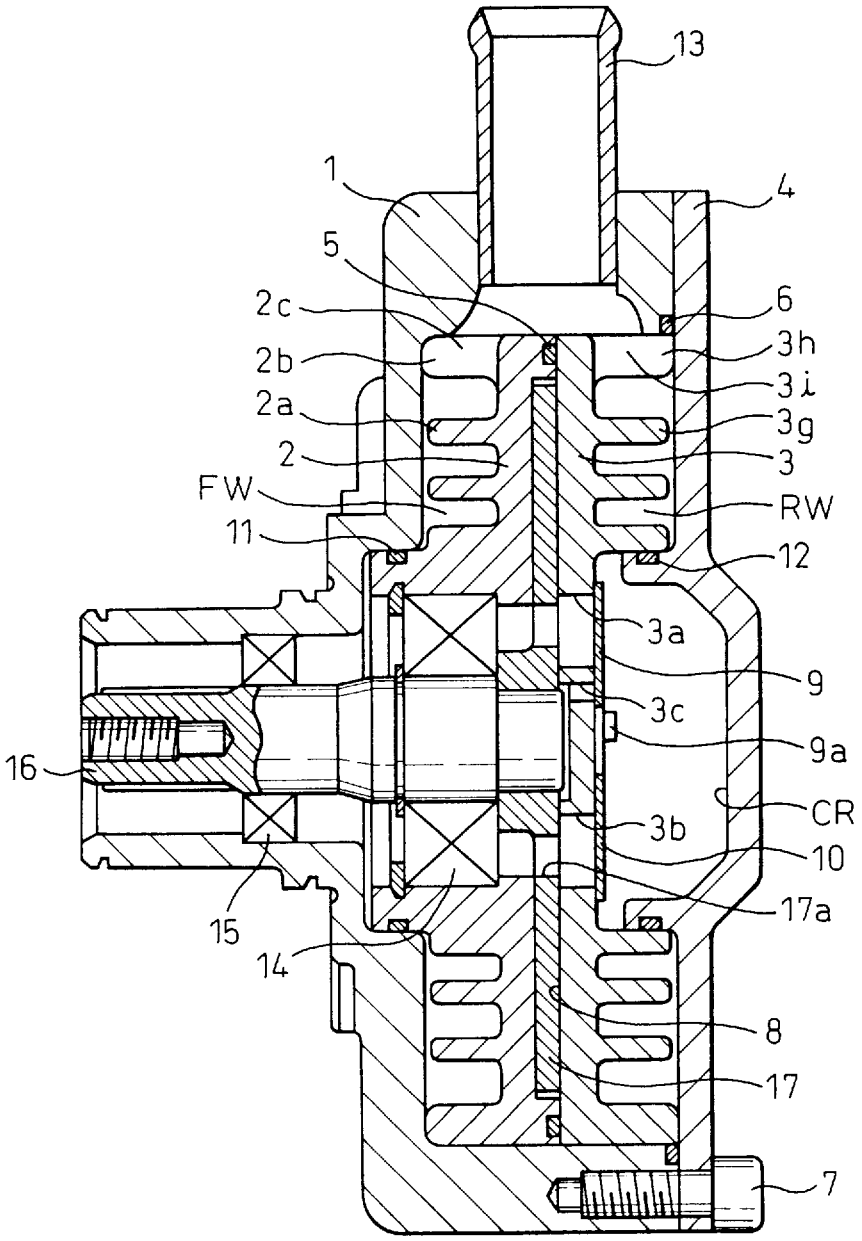
FIG. 1 is a cross-sectional view of a variable heat generating performance, viscous fluid type heat generator according to a first embodiment of the present invention.

FIG. 1 illustrates a variable heat generating performance, viscous fluid type heat generator according to the first embodiment of the present invention, which is in a posture to be mounted in a mounting region, e.g., an engine compartment of an engine-operated vehicle.

Referring to FIG. 1 through FIG. 3B, the viscous fluid type heat generator according to the first embodiment includes a housing assembly provided with a front housing body 1, a front plate member 2, a rear plate member 3, and a rear housing body 4. The front plate member 2 and the rear plate member 3 are axially combined together via a sealing element made of an O-ring 5 to define a later-described heat generating chamber, and are accommodated in the interior of the front housing body 1, and a rear open end of the front housing body 1 is closed by the rear plate 4 fixed to the front housing body 1 by means of a plurality of screw bolts 7.

The front plate member 2 is provided with a circular recess formed in a rear end face thereof and cooperates with a front end face of the rear plate element 3 so as to define a substantially cylindrical heat generating chamber 8 in which heat generation by a viscous fluid, typically a silicone oil, occurs when the viscous fluid is subjected to a shearing action by the rotation of a later-described rotor element 17.

The rear plate member 3 is provided with a fluid withdrawing passage 3*a* formed as a through-bore having open ends formed in the opposite faces of the rear plate member 3. The fluid withdrawing passage 3*a* opens toward an upper region of a radially central portion of the heat generating chamber 8. The rear plate member 3 is also provided with a fluid supplying passage 3*b* formed as a through-bore having open ends formed in the opposite faces of the rear plate member 3. The fluid supplying passage 3*b* opens toward a lower region of a radially central portion of the heat generating chamber 8. The fluid withdrawing passage 3*a* and the fluid supplying passage 3*b* are formed to have an identical diameter by taking into consideration the fact that one of the open ends of each of both passages 3*a* and 3*b* must be sealingly closed when the heat generator is operated at a low speed while generating a small amount of heat.

Figure 2:
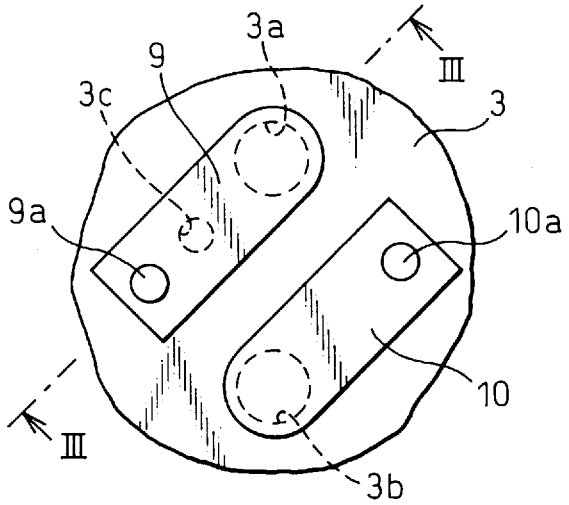
FIG. 2 is a partial plan view of a rear plate member of the heat generator of the first embodiment, illustrating an arrangement of flap valves relative to fluid supplying and withdrawing passages.
Figure 3A:
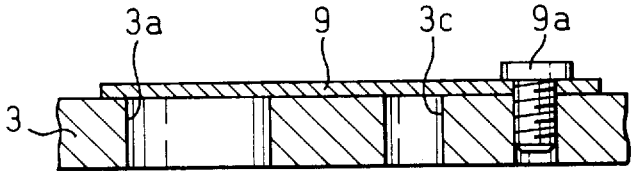
FIG. 3A is a partial cross-sectional view of the flap valve closing the fluid withdrawing passage of the heat generator of FIG. 1, illustrating the closing position of the flap valve.
Figure 3B:
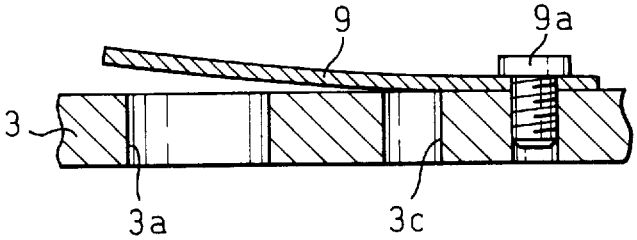
FIG. 3B is an identical cross-sectional view of the flap valve closing the fluid withdrawing passage of the heat generator of FIG. 1, illustrating the opening position of the flap valve.

As best shown in FIGS. 2, 3A and 3B, a flap valve 9 is attached, at its base end portion, to the rear plate member 3 by means of a screw bolt 9*a* so that a free end of the flap valve 9 may open and close an open end of the fluid supplying passage 3*a*. The flap valve 9 is formed as a valve element which may be deformed by application of either heat or pressure and is arranged in a later-described heat generation control chamber CR (FIG. 1).

The rear plate member 3 is further provided with a subsidiary fluid port 3*c* formed therein as a through-hole smaller than the fluid withdrawing passage 3*a*. The subsidiary fluid passageway 3*c* has one open end constantly opening toward the interior of the heat generating chamber 8, and the opposite open end opening toward an inner face of the flap valve 9, i.e., the face which faces the rear plate member 3. The subsidiary fluid port 3*c* is arranged as a valve deformation supplementing means and is disposed at a position between the fluid withdrawing passage 3*a* and the threaded hole of the rear plate member 3 in which the afore-mentioned screw bolt 9*a* is threadedly engaged. It should be understood that the diameter of the through-hole forming the subsidiary fluid port 3*c* is smaller than that of the fluid withdrawing passage 3*a* and that of the fluid supplying passage 3*b*.

As best shown in FIG. 2, a flap valve 10 similar to the flap valve 9 is attached, at its base end portion, to the rear plate member 3 by a screw bolt 10*a* so that a free end of the flap valve 10 may open and close an open end of the fluid supplying passage 3*b*. The flap valve 10 is also disposed in the heat generation control chamber CR. Each of the two flap valves 9 and 10 is made of a bimetallic material in the form of a flat plate deformable by heat, and is deformed to move from respective closing positions toward the opening positions thereof in response to an increase in the temperature of the viscous fluid, e.g., a silicone oil.

As shown in FIG. 1, the front plate member 2 is provided with a plurality of circular fins 2*a* formed in a radially outer region of the front face thereof. The radially innermost fin 2*a* is formed as an integral portion with a central boss portion of the front plate member 2 which is in contact with a portion of the inner face of the front housing body 1 via a sealing member 11 made of O-ring. The fins 2*a* project frontward and cooperate with the inner wall surface of the front housing 1 to define a front heat receiving chamber FW arranged adjacent to a front portion of the heat generating chamber 8 to receive therein a later-described heat exchanging liquid which receives heat from the front portion of the heat generating chamber 8.

The rear plate member 3 is provided with a plurality of circular fins 3*g* formed in a radially outer region of the rear face thereof. The radially innermost circular fin 3*g* of the rear plate member 3 is engaged with an inner boss portion formed in a radially middle portion of an inner surface of the rear housing body 4 via a sealing element 12 made of an O-ring. The circular fins 3*g* of the rear plate member 3 project rearward and cooperate with an inner wall surface of the rear housing body 4 to define a rear heat receiving chamber RW arranged adjacent to a rear portion of the heat generating chamber 8 to receive therein the heat exchanging liquid which receives heat from the rear portion of the heat generating chamber 8.

The radially innermost circular fin 3*g* of the rear plate member 3 and an inner boss of the rear housing body 4 cooperate with one another to define the afore-mentioned heat generation control chamber CR which can fluidly communicate with the fluid withdrawing passage 3*a*, and the fluid supplying passage 3*b*, and the above-mentioned subsidiary fluid port 3*c* in the form of a through-hole.

The front plate member 2 is provided with an outer support rib 2*b* projecting frontward from an outer circumferential portion of the front plate member 2. The support rib 2*b* formed as a circular wall portion in which a radial aperture 2*c* directly communicating with a later-described liquid inlet port 13 for heat exchanging liquid and a different radial aperture (not shown in FIG. 1) communicating with a liquid outlet port (not shown in FIG. 1) for the heat exchanging liquid.

The rear plate member 3 is provided with an outer support rib 3*h* formed as a circular wall portion in which a radial aperture 3*i* directly communicating with the liquid inlet port 13 and a different radial aperture (not shown in FIG. 1) communicating with the liquid outlet port are formed.

The front housing body 1 is provided with the above-mentione d liquid inlet port 13 and the liquid outlet port, which are arranged adjacent to one another in an outer circumference of the front housing body 1. The liquid inlet port 13 permits introduction of the heat exchanging liquid from an external heating system into the front and rear heat receiving chambers FW and RW via the above-mentioned apertures 2*c*, and 3*i*. The liquid outlet port permits delivery of the heat exchanging liquid toward the external heating system from the front and rear heat receiving chambers FW and RW via the apertures of the front and rear plate members 2 and 3.

The front plate member 2 has the afore-mentioned central boss portion in which an anti-friction bearing 14 having therein a sealing element is accommodated, and the front housing body 1 has a central hollow boss portion in which an anti-friction bearing 15 is accommodated. These anti-friction bearings 14 and 15 rotatably support an axial drive shaft 16.

The axial drive shaft 16 is arranged substantially horizontally, and has an inner end located in a region between the front and rear plate members 2 and 3. The drive shaft 16 supports thereon a rotor element 17 to rotate it within the heat generating chamber 8. The rotor element 17 is formed as a flat disk-like element keyed to the inner end of the drive shaft 16, and having flat opposite faces facing front and rear inner wall surfaces of the heat generating chamber 8. The rotor element 17 is provided with a plurality of through-holes 17*a* formed in a radially inner region of the flat faces thereof so as to provide a fluid communication between the front and rear portions of the heat generating chamber 8.

The viscous fluid for heat generation, typically a silicone oil, is supplied into the gaps between the outer faces of the rotor element 17 and the inner wall surfaces of the heat generating chamber 8, and into the heat generation control chamber CR. The amount of the viscous fluid supplied into the heat generation control chamber CR is adjusted so that the lower through-bore formed as the fluid supplying passage 3*b* is constantly positioned below the fluid level of the silicone oil within the heat generation control chamber CR. A small amount of air is contained in the heat generating chamber 8, the fluid withdrawing passage 3*a*, the fluid supplying passage 3*b*, and the heat generation control chamber CR, which unavoidably enters the chambers 8 and CR and the fluid passages 3*a* and 3*b* during the assembly of the viscous fluid type heat generator.

An outer front end of the drive shaft 16 is provided with an axial threaded bore formed therein to be threadedly engaged with a pulley (not shown) which receives a drive power from an external drive source, e.g., a vehicle engine via a belt member (not shown in FIG. 1).

When the viscous fluid type heat generator is incorporated in a vehicle heating system, and when the drive shaft 16 is rotationally driven by the vehicle engine, the rotor element 17 is rotated within the heat generating chamber 8 to apply a shearing action to the viscous fluid, i.e., the silicone oil held between the inner wall surface of the heat generating chamber 8 and the outer faces of the rotor element 17. Thus, the silicone oil generates heat which is transmitted to the heat exchanging liquid flowing through the front and rear heat receiving chambers FW and RW. Therefore, the heat exchanging liquid carries the heat to the vehicle heating system which heats an objective area such as a passenger compartment of the vehicle.

During the heat generating operation of the viscous fluid type heat generator, when the temperature of the silicone oil in the heat generation control chamber CR increases, the heating generation by the heat generator can be considered as being excessive. The silicone oil in the heat generating chamber 8 is permitted to flow into the fluid withdrawing passage 3*a* of the rear plate member 3 and additionally into the subsidiary fluid port 3*c*, and to come into contact with the inner face of the flap valve 9 at positions facing the passage 3*a* and the port 3*c*. Since the silicone oil in the subsidiary port 3*c* of the rear plate member 3 can apply additional heat to the flap valve 9 compared with the case where a viscous fluid type heat generator has no subsidiary fluid port 3*c*, an increased amount of heat is applied to the flap valve 9. Further, since the silicone oil in the subsidiary fluid port 3*c* of the rear plate member 3 heats the flap valve 9 at a position adjacent to the base end thereof, the thermal deformation of the flap valve 9 is increased to quickly move from its closed position shown in FIG. 3A to its open position shown in FIG. 3B, and accordingly, the fluid withdrawing passage 3*a* is quickly opened. Namely, the subsidiary fluid port 3*c* permitting introduction of the silicone oil therein from the heat generating chamber 8 urges the flap valve 9 to quickly deform to open the fluid withdrawing passage 3*a*. At this stage, in the first embodiment, the flap valve 10 is arranged so as to make a deformation thereof to quickly close the fluid supplying passage 3*b*.

It should be understood that the extent of the opening of the fluid withdrawing and supplying passages 3*a* and 3*b* may be minutely regulated at the stage of manufacturing and assembling of the viscous fluid type heat generator by adjusting an amount of deformation of the flap valves 9 and 10. Thus, the withdrawing of the viscous fluid (the silicone oil) and the supplying of the viscous fluid can be achieved so as to obtain an optimum controlling of the heat-generation performance of the heat generator.

Further, in the described first embodiment of the present invention, the flat plate-like flap valves 9 and 10 can be easily and fixedly attached to the rear plate member 3 by using only screw bolts 9*a* and 10*a* and the manufacturing and assembling of the flap valves 9 and 10 can be easily achieved with very low manufacturing cost. Further, the flap valves 9 and 10 can be small valve elements, respectively, and accordingly, the heat receiving chamber CR of the heat generator receiving therein the flap valves 9 and 10 can also be small. Therefore, the entire size of the viscous fluid type heat generator can be small allowing the heat generator to be mounted in a relatively small mounting area such as the engine compartment of a vehicle.

Due to the above-mentioned opening of the fluid withdrawing passage 3*a* and the closing of the fluid supplying passage 3*b*, the silicone oil in the heat generating chamber 8 has a fluid continuity with that in the heat generation control chamber CR via the opened fluid withdrawing passage 3*a* owing to the stretch viscosity of the silicone oil, and has no fluid continuity with that in the heat generation control chamber CR via the closed fluid supplying passage 3*b*. Accordingly, the silicone oil within the heat generating chamber 8 is withdrawn therefrom into the heat generation control chamber CR via the fluid withdrawing passage 3*a*, and the supply of the silicone oil from the heat generation control chamber CR into the heat generating chamber 8 via the fluid supplying passage 3*b* does not occur. During the withdrawing of the silicone oil from the heat generating chamber 8 into the heat generation control chamber CR, the silicone oil held between the front inner wall of the heat generating chamber 8 and the front outer face of the rotor element 17 is also withdrawn through the through-hole 17*a* of the rotor element 17 into the heat generation control chamber CR. Therefore, the heat generation by the silicone oil in the heat generating chamber CR is reduced, i.e., the heat-generation performance is reduced so as to reduce the supply of heat from the heat generator to the heating system.

From the foregoing description of the first embodiment, it can be understood that, according to the present invention, the fluid withdrawing passage 3*a* of the viscous fluid type heat generator can quickly and accurately provide a fluid communication between the heat generating chamber 8 and the heat generation control chamber CR by the opening movement of the flap valve 9 when the fluid withdrawing passage 3*a* should start the fluid withdrawing operation. Thus, a reduction in the heat-generation performance of the heat generator can be achieved quickly and accurately. Further, due to the reduction in the heat-generation performance of the heat generator, even if the rotating speed of the drive shaft 16 is kept high, the silicone oil in the heat generating chamber 8 is not excessively heated, and accordingly, degradation of the heat generating property of the silicone oil can be prevented.

On the other hand, during the operation of the heat generator, when the temperature of the silicone oil in the heat generation control chamber CR is low, the heating operation of the heating system can be considered as being excessively low. Thus, the flap valve 9 is thermally deformed so as to move to its closing position where the fluid withdrawing passage 3*a* is closed by the free end of the flap valve 9. The flap valve 10 is similarly thermally deformed so as to move to its opening position where the fluid supplying passage 3*b* is opened.

Thus, the silicone oil within the heat generating chamber 8 has a fluid continuity with that within the heat generation control chamber CR through the opened fluid supplying passage 3*b* due to the stretch viscosity of the silicone oil. On the other hand, the fluid continuity of the silicone oil between the heat generating chamber 8 and the heat generation control chamber CR via the fluid withdrawing passage 3*a* is cut by the closing of the fluid supplying passage 3*a*. Therefore, the silicone oil is supplied from the heat generation control chamber CR into the heat generating chamber 8 via the fluid supplying passage 3*b* without withdrawing of the silicone oil from the heat generating chamber 8 into the heat generation control chamber CR via the fluid withdrawing passage 3*a*. The silicone oil supplied into the heat generating chamber 8 is distributed into gaps between the front inner wall surface of the heat generating chamber 8 and the front outer face of the rotor element 17 through the through-holes 17*a* of the rotor element 17. Thus, heat generation by the silicone oil held between the inner wall surfaces of the heat generating chamber 8 and the outer faces of the rotor element 17 is increased. Namely, the heat-generation performance of the viscous fluid type heat generator of the first embodiment of the present invention can be increased to supply the vehicle heating system with an increased amount of heat.

It will be understood that according to the described first embodiment of the present invention, since an increase in the heat-generation performance of the viscous fluid type heat generator can be achieved by a reduction in the temperature of the silicone oil confined within the heat generator per se, an external controller to generate a control signal for increasing the heat-generation performance of the heat generator is not needed. Thus, the heating system incorporating therein the viscous fluid type heat generator according to the present invention can be an economical and low-cost-type heating system.

Further, in the above-described heat generator, during the withdrawing of the viscous fluid (the silicone oil) from the heat generating chamber 8 into the heat generation control chamber CR, and during the supplying of the silicone oil from the heat generation control chamber CR into the heat generating chamber 8, the total inner volume of the heat generating chamber 8, the fluid withdrawing passage 3*a*, the fluid supplying passage 3*b*, the subsidiary fluid port 3*c*, and the heat generation control chamber CR are not changed. Thus, the movement of the silicone oil does not generate a vacuum in the interior of the heat generator. Thus, the viscous fluid does not come into contact with fresh external air or any moisture. Therefore, degradation of the heat generating characteristics of the viscous fluid does not occur.

In the viscous fluid type heat generator according to the described first embodiment of the present invention, even if the drive shaft 16 is continuously rotated at high speed, replacement of the silicone oil, i.e., the viscous fluid in the heat generating chamber 8, with that in the heat generation control chamber CR constantly occurs. Accordingly, the viscous fluid is not subjected to overheating by which the heat generating characteristics of the viscous fluid is degraded. This fact, of course, ensures a high level heat-generation performance of the viscous fluid type heat generator after the continuous high speed operation of the heat generator. Further, a quick and accurate reduction in the heat-generation performance of the heat generator can be achieved by the heat generator according to the first embodiment of the present invention.

It should be understood that according to the first embodiment of the present invention, the flap valve 9 opening and closing the fluid withdrawing passage 3*a* is formed by a bimetallic type flat flap valve element. However, a reed type flap valve deformable in response to a change in pressure prevailing in the heat generating chamber 8 may be alternatively employed for opening and closing the fluid withdrawing passage 3*a* to achieve advantageous effects identical to those achieved by the bimetallic flap valve 9. When the reed type flap valve is incorporated in a viscous fluid type heat generator according to the present invention to form the flap valve 9 opening and closing the fluid withdrawing passage 3*a*, the subsidiary fluid port 3*c* acting as a valve deformation supplementing means introduces therein the viscous fluid from the heat generating chamber 8, and applies an increased pressure to the flap valve 9 to cause a supplementary deformation of the flap valve 9. Thus, the reed type flap valve 9 can be quickly deformed to quickly open the fluid withdrawing passage 3*a*.

Figure 4:
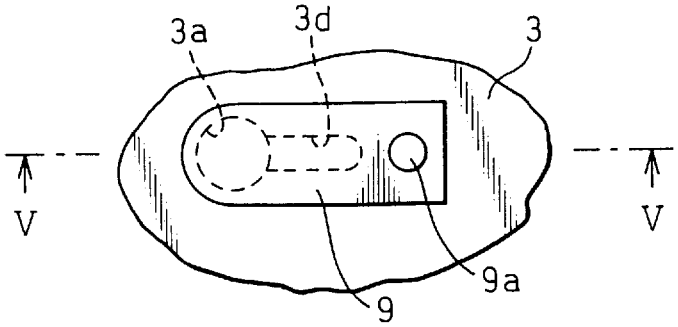
FIG. 4 is a partial plan view of a rear plate member and a flap valve closing a fluid withdrawing passage formed in the rear plate member according to a second embodiment of the present invention.
Figure 5:
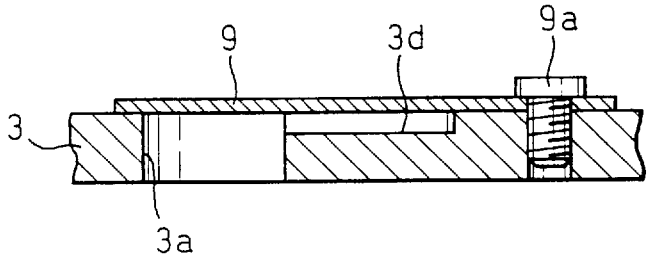
FIG. 5 is a partial cross-sectional view of the flap valve and the rear plate member of FIG. 4, illustrating the closing position of the flap valve; and, FIG. 6 is a partial plan view of a rear plate member of a viscous fluid type heat generator according to a third embodiment of the present invention, illustrating an arrangement of flap valves relative to fluid supplying and withdrawing passages.

FIGS. 4 and 5 illustrate a construction and an arrangement of a valve deformation supplementing means which cooperates with the flap valve to quickly open and close the fluid withdrawing passage of a viscous fluid type heat generator according to a second embodiment of the present invention.

In the viscous fluid type heat generator of the second embodiment, the valve deformation supplementing means is constituted by a subsidiary fluid port 3*d* in the shape of an elongated groove having one end directly and fluidly connected to the fluid withdrawing passage 3*a*. The groove-like subsidiary fluid port 3*d* introduces therein the viscous fluid from the heat generating chamber 8 to apply either an additional heat or an additional pressure to the inner face of the flap valve 9 at a position adjacent to the base end portion of the flap valve 9. Therefore, the flap valve 9 can be quickly opened with the assistance of the additional heat or pressure. The other internal construction of the viscous fluid type heat generator of the second embodiment is the same as that of the first embodiment.

Figure 6:
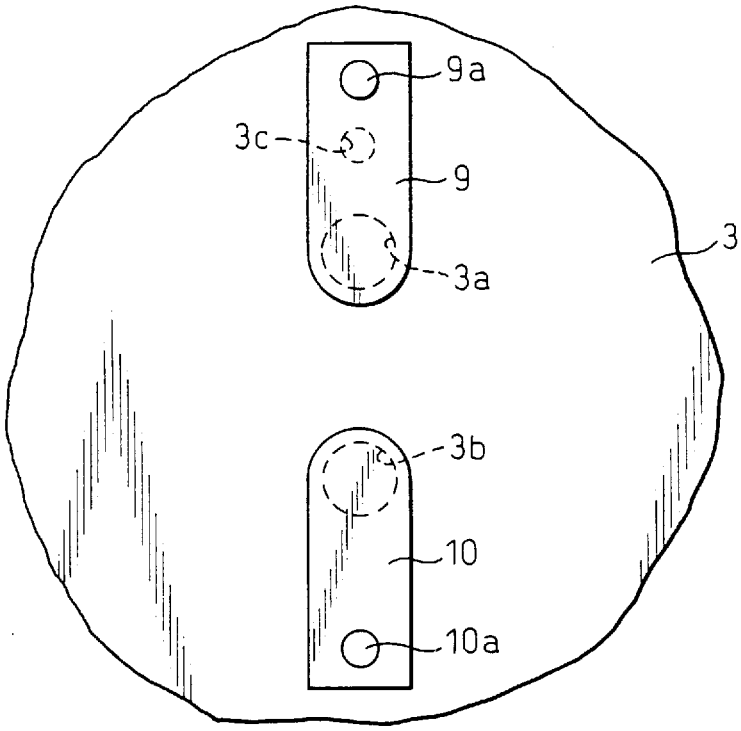

FIG. 6 illustrates a modified arrangement of a subsidiary fluid port 3*c* for supplementing deformation of the flap valve which opens and closes the fluid withdrawing passage. In the embodiment of the viscous fluid type heat generator, the flap valve 9 opening and closing the fluid withdrawing passage 3*a* and the flap valve 10 opening and closing the fluid supplying passage 3*b* are attached to the rear plate member 3 to be in alignment with one another so that the free end of the flap valve 9 closing the fluid withdrawing passage 3*a* is positioned directly above the free end of the flap valve closing the fluid supplying passage 3*b*. Namely, it should be understood that the flap valves 9 and 10 are arranged to be substantially radially symmetrical with one another with respect to the center of the rear plate member 3 in which the through-bores for forming the fluid withdrawing and supplying passages 3*a* and 3*b* are also arranged substantially symmetrically with respect to the center of the rear plate member 3. The subsidiary fluid port 3*c* is formed in the rear plate member 3 at a position where the port 3*c* communicates with an outer circumferential portion of the heat generating chamber 8. Further, the subsidiary fluid port 3*c* is positioned radially above the fluid withdrawing passage 3*a* to cause a large deformation of the flap valve 9 by heat or pressure to resultingly obtain a quick and wide opening of the fluid withdrawing passage 3*a*.

The arrangement of FIG. 6 can be effectively applicable to a particular case wherein the volume of the heat generation control chamber CR can be larger than that of an ordinary viscous fluid type heat generator according to the first embodiment of FIG. 1.

In the viscous fluid type heat generator, the heat generation by the viscous fluid held within the heat generating chamber 8 is very large in an outer region of the heat generating chamber 8 due to a high circumferential speed of the rotor element. Thus, when the subsidiary fluid port 3*c* is arranged at the position where the port 3*c* communicates with the outer region of the heat generating chamber 8 as shown in FIG. 6, the subsidiary fluid port 3*c* is able to introduce therein the high temperature viscous fluid from the outer region of the heat generating chamber 8. Thus, the large deformation of the flap valve 9 can be caused by the application of heat from the high temperature viscous fluid.

From the foregoing description of the preferred embodiments of the present invention, it will be understood that, according to the present invention, the variable-heat-generating performance, viscous-fluid-type heat generator can exhibit quick response characteristics in controlling the heat-generation performance thereof due to a quick and accurate movement of the flap valve opening and closing the fluid withdrawing passage in response to a heating requirement from a heating system in which the heat generator is incorporated. The heat generator also has an ability to prevent the viscous fluid confined therein from being degraded even after long use of the heat generator, arid even after a continuous high speed operation of the heat generator.

It should further be understood that many modifications and variations of the viscous fluid type heat generator will occur to persons skilled in the art without departing from the scope and spirit of the present invention as claimed in the accompanying claims.

We claim:

1. A variable heat-generation performance, viscous-fluid-type heat generator comprising:

a housing assembly defining therein a fluid-tight heat generating chamber in which heat is generated, and a heat receiving chamber arranged adjacent to said fluid-tight heat generating chamber to permit a heat exchanging fluid to circulate therethrough to thereby receive heat from said fluid-tight heat generating chamber, said fluid-tight heat generating chamber having inner wall surfaces thereof;

a drive shaft supported by said housing assembly to be rotatable about an axis of rotation thereof, said drive shaft being operatively connected to an external rotation-drive source;

a rotor element mounted to be rotationally driven by said drive shaft for rotation together therewith within said fluid-tight heat generating chamber, said rotor element having outer faces confronting the inner wall surfaces of said fluid-tight heat generating chamber via a predetermined gap;

a viscous fluid, filling the gap between said inner wall surfaces of said fluid-tight heat generating chamber of said housing assembly and said outer faces of said rotor element, for heat generation during the rotation of said rotor element, wherein said housing assembly further comprises:

a heat generation control chamber formed therein to have a given amount of volume for containing the viscous fluid therein;

a fluid withdrawing passage for passing the viscous fluid from said heat generating chamber toward said heat generation control chamber to permit at least a part of the viscous fluid in said heat generating chamber to be withdrawn into said heat generation control chamber for reducing a heat-generation performance of said viscous fluid type heat generator, said fluid withdrawing passage having opposite open ends thereof;

a fluid supplying passage for passing the viscous fluid from said heat generation control chamber toward said heat generating chamber to permit at least a part of the viscous fluid in said heat generation control chamber to be supplied into said heat generating chamber for increasing a heat-generation performance of said viscous fluid type heat generator, said fluid supplying passage having opposite open ends;

a flap valve means for closing one of the opposite open ends of said fluid withdrawing passage, said flap valve means being deformable to move from the closing position thereof; and, a valve deformation supplementing means for permitting the viscous fluid in said heat generating chamber to come into contact with said flap valve means to thereby urge said flap valve means to be supplementarily deformed to quickly open one of the opposite open ends of said fluid withdrawing passage, the opening of said fluid withdrawing passage permitting the viscous fluid to be withdrawn from said heat generating chamber into said heat generation control chamber via said fluid withdrawing passage so as to reduce a heat-generation performance of said heat generator.

2. A variable heat-generation performance, viscous-fluid-type heat generator according to claim 1, wherein said flap valve means comprises a thermally deformable bimetallic type flap valve having a free end operative to open one of the opposite ends of said fluid withdrawing passage and a base end by which said bimetallic type flap valve is attached to said housing assembly, and wherein said valve deformation supplementing means comprises a subsidiary fluid port formed in said housing assembly at a position adjacent to said base end of said bimetallic type flap valve.

3. A variable heat-generation performance, viscous-fluid-type heat generator according to claim 1, wherein said flap valve means comprises a thermally deformable bimetallic type flap valve having a free end operative to open one of the opposite ends of the fluid withdrawing passage and a base end by which said bimetallic type flap valve means is attached to said housing assembly, and wherein said valve deformation supplementing means comprises a fluid guide passage having one end arranged to fluidly communicate with an outer circumferential portion of said heat generating chamber.

4. A variable heat-generation performance, viscous-fluid-type heat generator according to claim 1, wherein said flap valve means comprises a pressure-deformable reed type flap valve having a free end operative to open one of the opposite ends of said fluid withdrawing passage and a base end by which said reed type flap valve is attached to said housing assembly, and wherein said valve deformation supplementing means comprises a subsidiary fluid port formed in said housing assembly at a position adjacent to said base end of said reed type flap valve.

5. A variable heat-generation performance, viscous-fluid-type heat generator according to claim 1, wherein said flap valve means comprises a pressure-deformable reed type flap valve having a free end operative to open one of the opposite ends of the fluid withdrawing passage and a base end by which said reed type flap valve is attached to said housing assembly, and wherein said valve deformation supplementing means comprises a fluid guide passage having one end arranged to fluidly communicate with an outer circumferential portion of said heat generating chamber.

6. A variable heat-generation performance, viscous-fluid-type heat generator, adapted for being accommodated in a heating system of an engine-operated vehicle, comprising:

front and rear housing bodies axially and fixedly connected together to form an outer housing of said heat generator;

front and rear plate members axially and fixedly arranged within said outer housing formed by said front and rear housing bodies to form an inner housing;

a fluid-tight heat generating chamber defined in said inner housing formed by said front and rear plate members, said heat generating chamber having inner wall surfaces thereof;

a heat receiving chamber defined between said outer housing and said inner housing, and arranged adjacent to said heat generating chamber to permit a heat exchanging fluid to flow therethrough to thereby receive heat from said heat generating chamber;

an axial drive shaft supported horizontally by said outer and inner housings to be rotatable about an axis of rotation thereof, said horizontal drive shaft being operatively connected to an engine of said vehicle;

a rotor element mounted to be rotationally driven by said horizontal drive shaft for rotation together therewith within said heat generating chamber, said rotor element having outer faces confronting said inner wall surfaces of said heat generating chamber via a predetermined gap;

a viscous fluid, filling said predetermined gap between said inner wall surfaces of said heat generating chamber and said outer faces of said rotor element, for heat generation due to an application of shearing action by said rotor element during the rotation;

a heat generation control chamber formed between said outer and inner housings to have a given amount of volume for containing a predetermined amount of viscous fluid therein;

a fluid withdrawing passage arranged to provide a fluid communication between said heat generating chamber and said heat generation control chamber, said fluid withdrawing passage permitting at least a part of the viscous fluid in said heat generating chamber to be withdrawn into said heat generation control chamber for reducing a heat-generation performance of said viscous fluid type heat generator, said fluid withdrawing passage having opposite open ends thereof;

a fluid supplying passage arranged to provide a fluid communication between said heat generating chamber and said heat generation control chamber, said fluid supplying passage permitting at least a part of the viscous fluid in said heat generation control chamber to be supplied into said heat generating chamber for increasing a heat-generation performance of said viscous fluid type heat generator, said fluid supplying passage having opposite open ends;

a flap valve for fluid withdrawal arranged to close one of the opposite open ends of said fluid withdrawing passage, said flap valve for fluid withdrawal being deformable to move from a closing position thereof to an open position thereof; and, a valve deformation supplementing means for permitting the viscous fluid in said heat generating chamber to come into contact with said flap valve for fluid withdrawal to thereby urge said flap valve for fluid withdrawal to be supplementarily deformed to quickly open one of the opposite open ends of said fluid withdrawing passage, the opening of said fluid withdrawing passage permitting the viscous fluid to be withdrawn from said heat generating chamber into said heat generation control chamber via said fluid withdrawing passage so as to reduce a heat-generation performance of said heat generator.

7. A variable heat-generation performance, viscous-fluid-type heat generator according to claim 6, further comprising:

a flap valve for fluid supply arranged to close one of the opposite open ends of said fluid supplying passage, said flap valve for fluid supply being deformable to move from an open position thereof to a closing position thereof substantially in synchronization with the opening of said flap valve for fluid withdrawal when the heat-generation performance of said heat generator should be reduced.

8. A variable heat-generation performance, viscous-fluid-type heat generator according to claim 7, wherein said heat receiving chamber comprises a substantially annular front heat receiving chamber defined between said front housing body and said front plate member, and a substantially annular rear heat receiving chamber defined between said rear plate member and said rear housing body, said front and rear heat receiving chambers being arranged adjacent to front and rear radially outer portions of said heat generating chamber, respectively, and wherein said heat generation control chamber is defined between said rear plate member and said rear housing body and arranged adjacent to a substantially central portion of said heat generating chamber, said fluid withdrawing passage and said fluid supplying passage being formed as through-bores bored in said rear plate member so as to provide a fluid communication between said central portion of said heat generating chamber and said heat generation control chamber.

9. A variable heat-generation performance, viscous-fluid-type heat generator according to claim 8, wherein said flap valve for fluid withdrawal and said flap valve for fluid supply are arranged in said heat generation control chamber, and are attached to said rear plate member so as to close said through-bores forming said fluid withdrawing and fluid supplying passages, respectively, and wherein said valve deformation supplementing means comprises a small through-hole formed in said rear plate member and arranged adjacent to said through-bore forming said fluid withdrawing passage, said small through-hole forming said valve deformation supplementing means introducing therein the viscous fluid from said heat generating chamber and permitting said viscous fluid to come into contact with said flap valve for fluid withdrawal.

10. A variable heat-generation performance, viscous-fluid-type heat generator according to claim 8, wherein said through-bores forming said fluid withdrawing passage and said fluid supplying passage, and said small through-hole forming said valve deformation supplementing means are arranged to be in alignment with one another in said rear plate member along a line vertical to said axis of rotation of said horizontal drive shaft and said rotor element.

* * * * *